United States Patent [19]

McCain et al.

[11] Patent Number: 4,875,669

[45] Date of Patent: Oct. 24, 1989

[54] SIGNATURE GATHERING MACHINES

[75] Inventors: William B. McCain, Hinsdale; George D. Higgins, Orland Park, both of Ill.

[73] Assignee: McCain Manufacturing Corporation, Chicago, Ill.

[21] Appl. No.: 246,910

[22] Filed: Sep. 16, 1988

Related U.S. Application Data

[63] Continuation-in-part of Ser. No. 100,273, Sep. 23, 1987, abandoned.

[51] Int. Cl.[4] ..... B65H 39/02

[52] U.S. Cl. ..... 270/54

[58] Field of Search ..... 270/54–58

[56] References Cited

U.S. PATENT DOCUMENTS 2,413,358 12/1946 Kleineberg ..... 270/54

3,809,384 5/1974 Zugel ..... 270/54

4,180,255 12/1979 Himmel ..... 270/54

4,299,378 11/1981 Müller ..... 270/54

4,625,952 12/1986 Schniter ..... 270/54

*Primary Examiner*—Robert E. Garrett

*Assistant Examiner*—Therese M. Newholm

*Attorney, Agent, or Firm*—Kinzer, Plyer, Dorn, McEachran & Jambor

[57] ABSTRACT

Signature gathering machine in which signatures are extracted by an extracting cylinder successively from a hopper, released at a register gauge, opened by grippers on opposed opening cylinders and then those grippers are opened to drop the signature onto a saddle conveyor; wipers rotate with the extracting cylinder and are actuated in timed relation to arrival of the signature at the register gauge so as to force the free edges of the signature into the space between the opening cylinders.

15 Claims, 2 Drawing Sheets

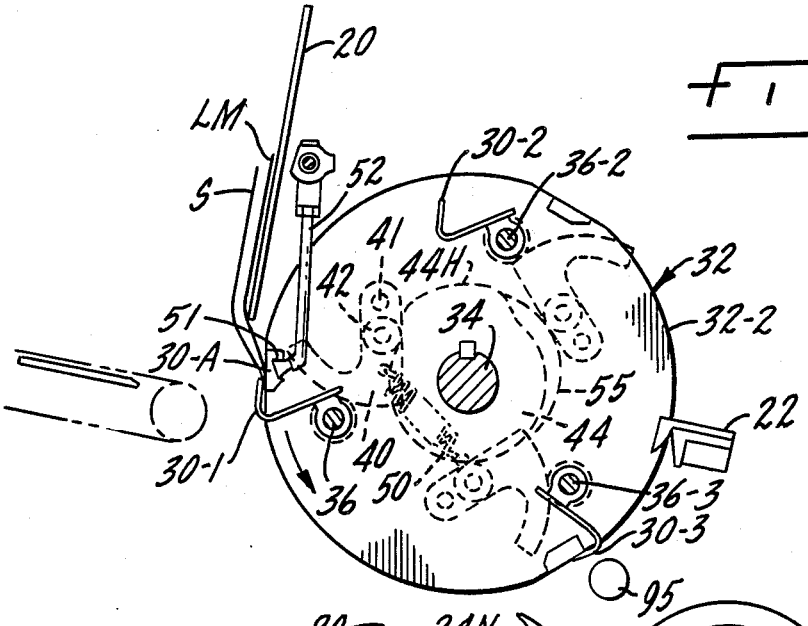
Fig. 6.
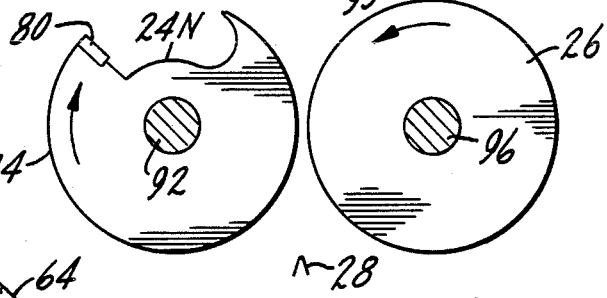
Fig. 7.
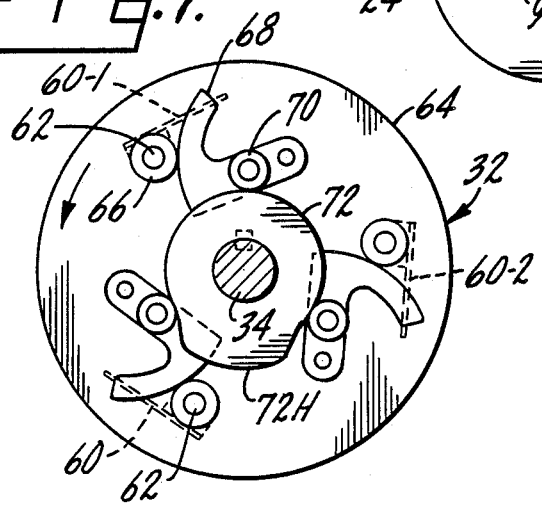
Fig. 8.
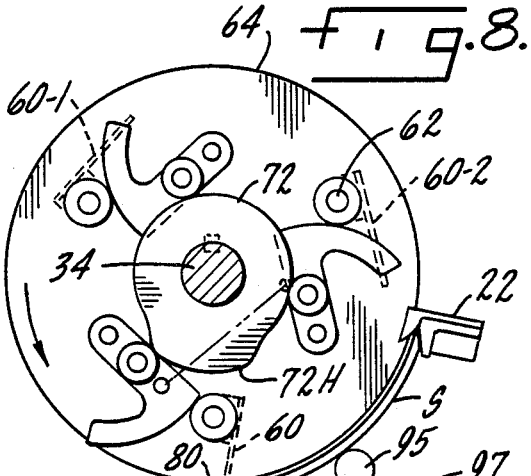
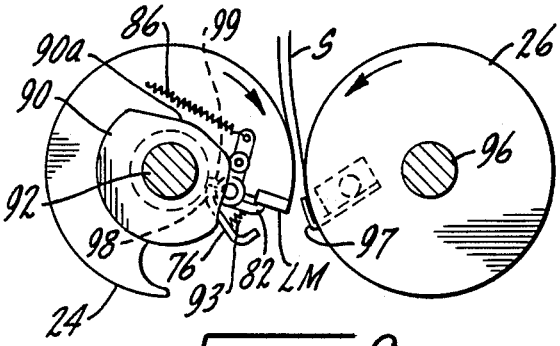
Fig. 9.
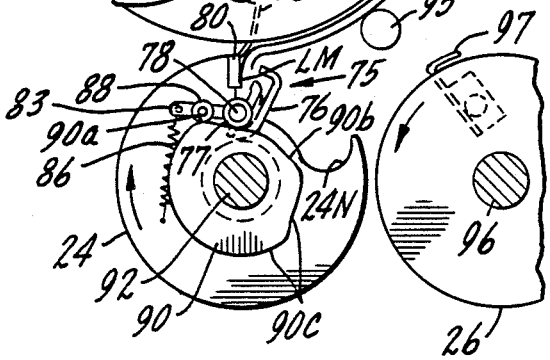

SIGNATURE GATHERING MACHINES

This is a continuation-in-part of copending application Ser. No. 100,273 filed on Sept. 23, 1987 now abandoned.

This invention relates to signature machines employed to feed signatures from hoppers onto a traveling gatherer or collector. The result is a book or magazine. The gatherer or collector moves past the hoppers. Folded sheets, known as signatures, are fed one atop another onto the collector. After the collection of signatures has been completed, the magazine or book then goes to a stitcher station where the backbone is stapled or stitched, completing the book except for trimming.

BACKGROUND OF THE INVENTION

The signature machine addressed by the present invention is generally well known. An extracting cylinder rotates adjacent a hopper in which signatures are stacked The signature next to be fed to the gatherer is extracted from the hopper by a clamp of one form or another and the clamped signature is carried by the extracting cylinder to a stop or register gauge. Here, the signature is released so that it may be opened by spreading the leaves or sheets of the signature There may be as many as twenty or thirty hoppers, each with its own extracting cylinder. The extracting cylinder is sometimes called a drum, but regardless of the name it is usually a pair of rotating discs keyed to a driven shaft.

Opening of the signature is accomplished by two smaller cylinders positioned beneath the extracting cylinder. One cylinder is generally known as the opening cylinder, and the other cylinder is usually termed the lap cylinder. These two cylinders are also equipped with clamps effective to clamp the free edges of the respective legs or sheets of the signature. The cylinders rotate in opposed directions so that the clamps are effective to open or spread the signature, eventually dropping it on to the gatherer.

The signature is folded unevenly so that there is a short sheet and a long sheet. The long sheet is distinguished by its so-called lap margin, this being the portion of the free edge which is longer than the short sheet. The extended or longer margin plays an important role in effectively opening the signature and assuring rapid, continuous operation.

Dependable operation at high speed, without jamming, involves assurance the clamp on the lap cylinder will effectively clamp the lap margin. This is not only a delicate matter of proper timing, it also involves the inertia characteristics of the paper signature at the time it has been released by the extracting cylinder, ready to be opened by the clamps on the lap cylinder and the opening cylinder.

To assure dependable operation from the standpoint of effectively clamping the lap margin by the clamp on the lap cylinder, it has been proposed to employ a pair of reciprocating fingers (see U.S. Pat. No. 2,413,358, Kleineberg) intended to support the free edges of the signature at the phase of the cycle where the clamp on the lap cylinder is to become effective. Afterwards, these fingers are withdrawn. The actual mode of operation of the positioning fingers may be widely varied, but in any event there are linear motions which introduce vibration, the mechanism requires a great deal of space which limits the number of signatures which can be fed in a cycle of operation, and the fingers must be positioned outside the extracting cylinder, which s to say neither finger can be located between the rotating discs which define the extracting cylinder.

OBJECTIVES OF THE INVENTION

The primary object of the present invention is to employ fingers or wipers which are mounted on the extracting cylinder, thereby greatly reducing extraneous vibrations and a related object of the invention is to considerably reduce the space within which the motion of the wipers or fingers takes place. This, for example, allows as many as three signatures to be delivered in one cycle of operation.

Another object of the invention is to operate and time the wipers by a segment gear and pinion which for many, many years has proven an eminently satisfactory device for operating the extracting grippers themselves in precise timed relationship. Also, under the invention as another object, it is possible to have the wipers inside the extracting cylinder, rather than outside, and this allows an option or choice of operating at the extremities of the paper or in the medial portion of the paper.

DESCRIPTION OF THE DRAWING

FIG. 6 is a sectional view substantially on the lines 6—6 of FIG. 5;

FIG. 7 is a sectional detail view substantially on the lines 7—7 of FIG. 5, showing the operating details for the wipers;

FIG. 8 is a sectional view illustrating in detail the manner in which a wiper cooperates in timed relationship with the gripper mechanism on the lap cylinder; and FIG. 9 is a detail view of the gripper mechanism of the lap cylinder and opening cylinder in a gripping condition.

DETAILED DESCRIPTION

As noted above, the signature gathering machine featured in the present invention is well known and in principle has been used for approximately half a century. As the description proceeds, reference should be made from time to time to FIG. 5 which is a scale drawing showing the general spaced relationship of the parts associated with the extracting cylinder. On the other hand, FIGS. 1–4 are for the most part schematic illustrations of the sequence of operation.

Figure 1:
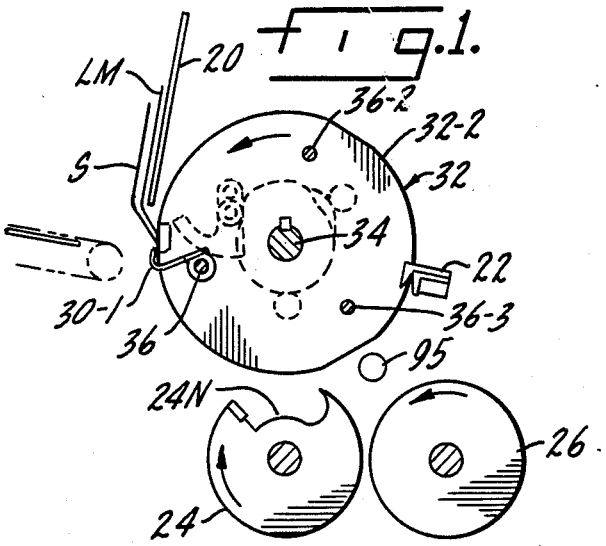
FIGS. 1, 2, 3 and 4 are simplified elevational views illustrating sequences in operation of the present machine.

In the known machine, signatures S are supplied from a hopper 20, FIG. 1. Each signature may be viewed simply as a folded sheet which is to be withdrawn from the hopper 20 and carried around to a register gauge 22, FIG. 2, where it is released. The signature thus released is next to be clamped at its free edges by respective clamps on a lap cylinder 24 and an opening cylinder 26, FIG. 3. These clamps eventually diverge, FIG. 4, and are opened to drop the signature onto a saddle conveyor 28. For convenience, each cylinder 24 and 26 will be termed herein the opening cylinder, as each has that role.

The signatures are extracted from the hopper one by one in sequence by grippers as 30-1, FIG. 1, supported on an extracting cylinder 32. The term "extracting cylinder" is a term of art and in reality includes a pair of discs as 32-1 and 32-2, FIG. 5, keyed for rotation on a driven shaft 34. There are two other discs included as part of the extracting cylinder as will be explained.

Figure 5:
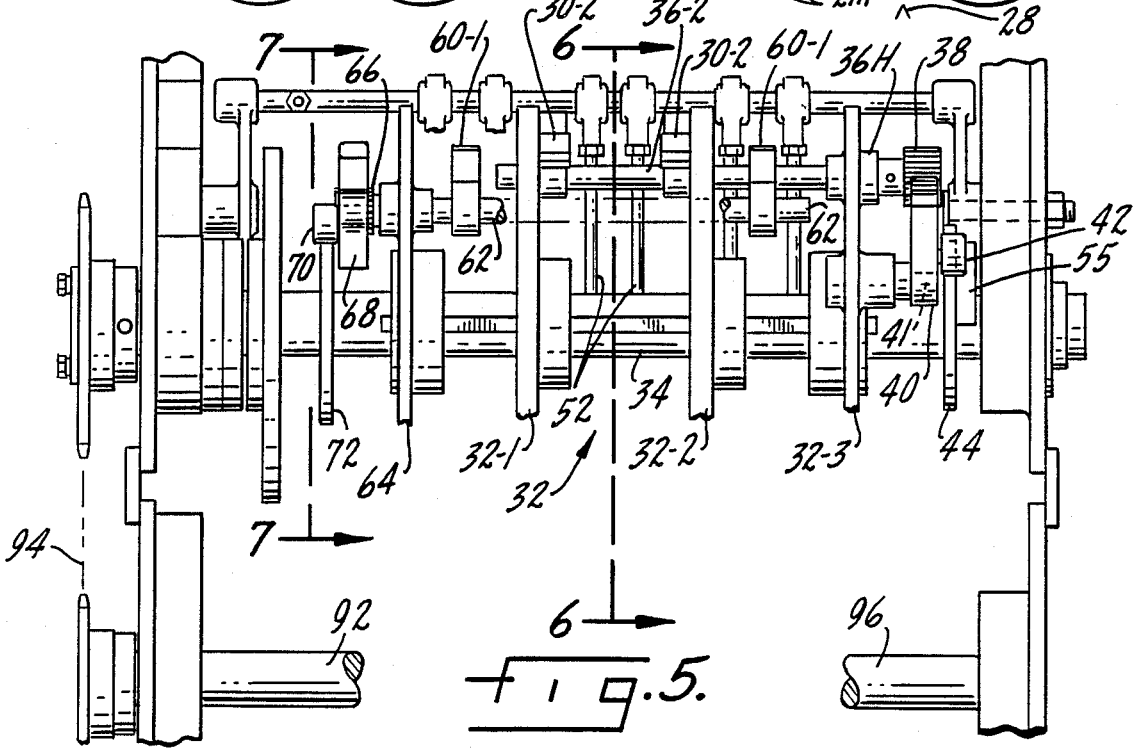
FIG. 5 is an end elevation of the machine, on an enlarged scale compared to FIGS. 1–4.

Referring to FIGS. 5 and 6, the grippers are arranged in pairs (a pair of grippers 30-2, FIG. 5) supported on a rock shaft 36. This rock shaft extends through openings in the extracting cylinder. It is supported rotatably in a hub 36H secured to a disc 32-3, keyed to shaft 34. There is a pinion gear 38 at one end of the rock shaft 36 and this pinion is related to an operating segment gear 40 pivotally mounted at 41 on a disc 32-3 and spring-biased so that a cam follower 42 carried on the segment gear is urged against a fixed cam 44.

Cam 44 has a lobe or high part 44H and a spring 50 for each segment gear, FIG. 6, tends to hold the cam follower 42 against the cam 44 to follow the contour thereof. This spring tends to close the gripper as 30-1 whereas the high part 44H of the cam rocks the gear segment and its pinion to open the gripper. The extracting cylinder may have several sets of grippers as will be explained.

Gripper 30-1 is shown in FIG. 1 in its closed position, effective to clamp the backbone of a extracted signature being extracted against a cooperating anvil 30A on the extracting cylinder. Just before this happened, suction cups 51 were effective to apply suction to and partly extract the folded lower part of the signature (backbone) to locate the fold of the signature in position to be clamped against the anvil 30A. The suction cups are supported by hollow tubes 52 connected to a source of vacuum.

The signature thus picked up by the paired grippers 30-1 moves counterclockwise on and with the extracting cylinder assembly 32 until the fold or backbone is against the register gauge 22 and at this time the grippers 30-1 are opened to release the signature. The register gauge will be so positioned that the signature released thereto will have its lap margin accurately positioned as will be described in connection with operation of the opening cylinders 24 and 26. It may be mentioned in this connection that in FIGS. 1 and 2 no attempt is made to necessarily depict in an accurate rotational sense the exact position of the two cylinders 24 and 26 with respect to any particular position of the extracting cylinder 32.

The timing cam 44, which times opening and closing of the grippers, will be positioned initially at the time of installation so that the grippers will close properly on the backbone of the signature presented by the suction cups. Likewise the register gauge will be properly adjusted. Then, an adjustable cam patch 55, FIG. 5, on cam 44 is turned to lengthen or shorten the effective cam dwell surface (depending on the signature length) to allow the grippers to be opened by the cam lobe 44H just when the signature backbone is at the register gauge; the grippers remain open with the cam follower 42 riding on the cam lobe until they are once more back on the hopper side when the cam follower rides off the cam lobe, allowing the gripper spring to close the gripper.

As indicated in FIG. 1, and as shown in detail in FIG. 6, there are several sets of grippers 30-1, 30-2 and 30-3 each set being supported on its own rock shaft 36, 36-2 and 36 3, operated and controlled in the manner explained in terms of rock shaft 36 for the gripper set 30-1.

As already noted, the signatures are unevenly folded so that there is a long leg with a lap margin LM, FIGS. 1 and 6. The lap margin is not large and the present invention for the most part is concerned with wipers or tucker fingers which assure the lap margin will be presented to a clamp assembly located within a large notch 24N on the perimeter of the opening cylinder 24 as will now be described.

Figure 2:
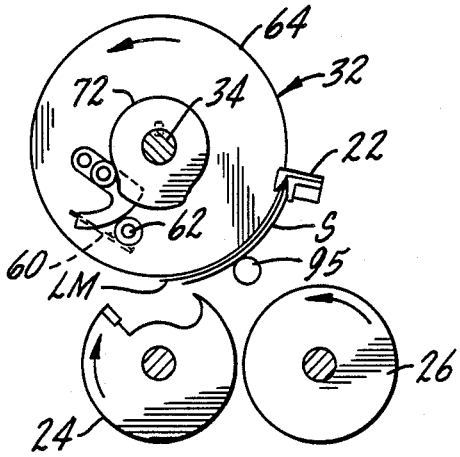
Figure 3:
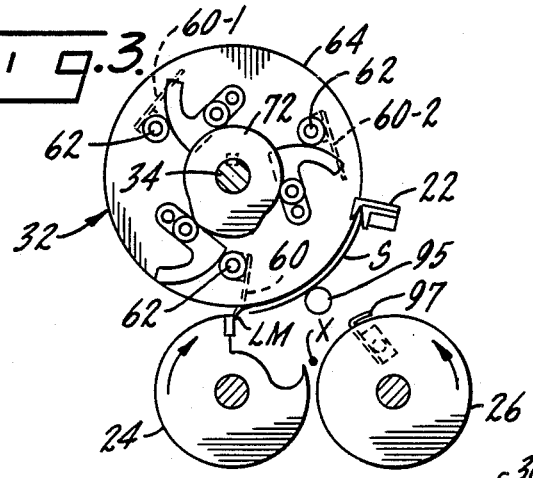

Under and in accordance with the present invention the extracting cylinder 32 is equipped with sets of wipers or tucker blades 60, FIG. 2, of which there may be as many as three sets 60, 60-1 and 60-2 as shown in FIG. 3. The wipers are thus synchronized in an absolute sense with the extracting cylinder. In FIG. 2, a wiper finger 60 is shown in its retracted or inoperable position, approximately as the signature S is reaching the register gauge 22. A moment later, FIG. 3, the signature S has been released and the wiper finger 60 is actuated to its operable position where it engages the trailing edge of the signature to force it into the notch section of the cylinder 24. This operable position of the wiper or displacement finger prevails until the free margins of the signature have been clamped to cylinder 24, as hereinafter explained, and during this interim period the wiper or displacement blade in its operable position is effective to travel along the signature in the direction of the register gauge, constantly pressing the signature down.

It may here be noted that each wiper 60, FIG. 5, is secured to a rock shaft 62 rotatably supported in a hub secured to a disc 64, just as each rock shaft as 36 for the signature clamps as 30-1, 30-1 is supported by the disc 32-3 as described above. Also, as in the instance of the disc 32-3, disc 64 is keyed to the extracting cylinder shaft 34 so that it is part of the extracting cylinder in the collective sense as the term "extracting cylinder" is understood in the art. The rock shafts for the wiper extend freely through openings in the discs 32-1 and 32-2.

The wipers need to be accurately timed for oscillation between the operable and inoperable position, just as the signature clamps are timed for accurate operation with respect to the position of the supply hopper and register gauge 22. Preferably such timing is accomplished in the same manner as the signature clamps because this manner of timing has been employed successfully for many years. Thus, each rock shaft 62 which carries a pair of wipers as 60 is provided at one end with a pinion gear 66, FIG. 5, meshed with a related segment gear 68. The segment gear is provided with a cam follower 70 opposed to a cam 72. The cam 72, like the cam 44, is fixed.

Figure 4:
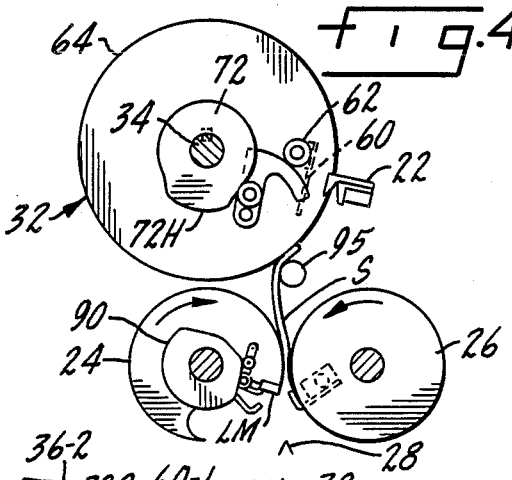

As shown in FIGS. 4 and 7, the cam 72 has a high part or lobe 72H. Each segment gear 68 is spring-biased so that its follower 70 is urged against the perimeter of the cam 72. The cam lobe 72H is configured and positioned so that the segment gear is oscillated to rotate its pinion 66 counterclockwise as viewed in FIG. 7, positioning the wiper 60 in its operable position, at the time the fold or backbone of the signature is against the register gauge 22, and this also coincides in time with the trailing edge of the large notch in cylinder 24 attaining a position where its clamp structure 75, FIG. 8, is ready to capture the extended margin LM. In other words, the timing is such that the wipers are actuated to their effective position as a gripper set 75 (opening cylinder) is opposed to or adjacent the free edge of the signature released to the register gauge.

The construction and operation of the clamp structure 75, FIG. 8, will be explained shortly but it may be mentioned at this point that each rock shaft 62 may be equipped with several wipers 60 and indeed in most instances will be so equipped. The wipers 60, under and in accordance with the present invention, may thus be located at the outside of the extracting cylinder discs 32-1, 32-2 or between them especially if there are only two sets of grippers on the extracting cylinder 180° apart leaving ample room for two sets of wipers. This is of particular advantage and significance because, depending upon the texture and size of the paper signature, the wipers may be more effective on the middle of the signature than on the outer margins.

Each of opening cylinders 24 and 26 may also be paired discs as in the instance of the extracting cylinder. The gripper assembly 75 (or set) on cylinder 24 comprises a main gripper 76 having a hub 77 secured to a rock shaft 78, FIG. 8. The main gripper is opposed to a gripper seat 80 at the trailing edge of the lap cylinder notch 24N. There is a second, shorter gripper 82, and it is this gripper which clamps the lap margin LM against the gripper seat 80. The short gripper 82 projects from a collar (not shown) loosely mounted on the rock shaft 78, compared to the hub 77 of the main gripper 76 which is secured to the rock shaft 78.

Actuation of the main gripper is effected by an arm 83 extending from the hub 77 and a strong spring 86 tends to hold a cam follower 88 on arm 83 against the perimeter of a fixed control cam 90. The spring 86 tends to close the clamp 76.

The cylinder 24 is keyed to a driven shaft 92 in turn driven by a chain 94, FIG. 5, connected to a sprocket at one end of shaft 34. The chain 94 and related sprockets will have a drive ratio matched or synchronized to the delivery of signatures from the extracting cylinder. Shaft 96, FIG. 8, for the opening cylinder 26 will be geared to shaft 92 in a 1:1 ratio at all times. If the extracting cylinder is to extract three signatures per cycle, then cylinders 24,26 will be rotated three turns for one turn of the extracting cylinder.

Cylinder 24 with its clamp or gripper assembly rotates about the cam 90; cam 90 is responsible for operating the gripper assembly 75 as will now be described.

The operative movements of both grippers on the opening cylinder 24 are under control of the fixed cam 90 about which the arm 83 and its follower 88 rotate with the cylinder 24 on which the rock shaft 78 is supported. A light compression spring 93, FIG. 9, is interposed between the short clamp 82 and the long clamp 76, tending always to close the short gripper 82 on the lap margin, against anvil 80.

Cam 90 has a short dwell **90*a* (low part of the cam) and when the follower 88 is on this part of cam 90, just at the commencement as shown in FIG. 8, the clamping structure 75 is conditioned for closing under the effect of spring 86. The two clamps thus respectively engage the lap margin LM (short clamp 82) and the free margin of the shorter sheet is engaged by the longer clamp 76. With both clamps being closed on the free margins of the released signature, the latter is stripped out of the register gauge and is rapidly flexed about a guide 95. As cylinder 24 continues to rotate, so does cylinder 26 and its clamp 97 starts to approach the notch in the opposed opening cylinder 24**.

The cam 90 has a second low part or dwell **90*b*. When the follower 88 reaches the dwell portion 90*b*, the longer clamp 76 commences to undergo a retraction and the free edge of the short sheet is released so that it may be clamped and captured by clamp 97 on the opening cylinder 26. This is a difficult motion to visualize but by looking at FIG. 3 it can be perceived that if the free edge of the short leg of the signature be imagined as located at point X, with gripper 97 also at point X, clamp 97** just at the moment it passes point X can be closed to clamp the free margin of the short leg of the signature.

Further travel of the follower 88 beyond the right hand edge of the cam flat **90*b* brings cam rise 90*c* into effect to swing away still further the gripper 76, which causes retraction of the gripper 82 from engagement with the lap margin LM. For this purpose, there is a lug 98 extended from the hub 77 of the main gripper 76 and an opposed lug 99 or projection on the collar of the gripper 82 which is loose on the rock shaft 78. When the two clamps are at the edge or threshold of their fully released position, FIG. 8, these two lugs are in engagement and when follower 88 reaches the limit of cam dwell 90*b*, ready to follow the high part or lobe 90*c* of cam 90, lug 98 forces lug 99 against the closing action of spring 93, whereupon the margin LM is released. Clamp 97** is opened at the same time.

When the two clamps or grippers 76 and 82 are closed, the lug 98 associated with clamp 76 is retracted from the opposed lug 99, but when the cam follower 88 achieves the cam rise **90*c*, the lugs are brought into engagement, forcing the clamp 82 to its fully released position, and at this same time, clamp 97 is opened along with clamp 97** and the signature is in a free fall state, falling onto the gathering chain.

Gripper 97 is operated by a cam and cam follower (not shown) as is well known. Also, there may be sets of grippers on the opening cylinders, 180° apart, depending upon the delivery rate.

SUMMARY

Different manufacturers have their own details of construction from the standpoint of clamp actuation, register gauge, hopper location, opening cylinder position as related to the extracting cylinder, gathering conveyor and so on. This is especially so when comparing American and European machines. These differences in details of construction do not limit practice of the present invention since it is a matter of equipping the extracting cylinder (always present) with the wipers and timing actuation of the wipers as above described so that the grippers on the opening cylinders always present, may capture the signature and spread (open) it for release to the conveyor, which will be of the well known saddle type.

The number of gripper sets on the extracting cylinder and opening cylinders may vary but the timing will always be such that the wipers are effective when the opening cylinder gripper as 75 is adjacent the free edges of the signature to be opened and released to the saddle conveyor. At this time, FIGS. 2 and 8, the free edges of the signature are unsupported and tend to fall (droop) downward toward the opening cylinder. Also, at this time, the wipers are moved from their retracted position within (at or inside) the perimeter of the opening cylinder discs, FIGS. 2 and 7, to their actuated position. extended beyond said perimeter, forcefully to press or nudge the unsupported free edge of the signature into the gap between the gripper 76 and its opposed gripper seat 80, FIG. 8. It will also be observed, FIG. 8, that when the backbone of the signature is at the register gauge 22, released by the extracting grippers, the angular position between the actuated wiper 60 and the register gauge is less than the angle subtended by the released signature on the extracting cylinder. In other words, the arc occupied by the released signature on the extracting cylinder is just slightly greater than the arc separating the register gauge and the wiper, so that the wiper in its actuated position (having moved from within the perimeter of the extracting cylinder to a position outside the perimeter) bends the free edges of the signature downward into the gap 76–80. As is well known, the register gauge is adjustable, but once adjusted for a particular signature is fixed, always to assure the signature released thereto is in position to have its free edges opened in the manner already explained. In any event, by having the wipers mounted on the extracting cylinder to revolve therewith, and positioned as aforesaid, vibrational reciprocal wiper movements are eliminated (compare U.S. Pat. Nos. 2,413,358 and 4,180,255) and it becomes practical to balance the extracting cylinders with as many sets of wipers as grippers. The wipers may be inside (between) or outside the discs which constitute the extracting cylinder; the grippers may be arranged to have both inside and outside positions in combination.

Hence while we have illustrated and described a preferred embodiment of the present invention it is to be understood this is capable of variation and modification within the purview of the appended claims.

We claim:

1. Cyclically operable signature gathering machine having a supply station from which folded signatures, each with a folded backbone and two sheets or legs extended therefrom, of which one sheet is longer to present an extended free margin beyond that of the shorter sheet, are to be extracted one by one by capturing the backbone of each by extracting grippers on a cyclically rotating extracting cylinder, said cylinder being defined by at least a pair of spaced discs, whereafter the captured signature is released from the extracting cylinder ~~in~~ the course of one turn and the two legs of the released signature opened respectively by gripper means on a pair of opening cylinders which then in turn release the opened signature to a signature gatherer, characterized by wipers supported by and between said discs for rotary movement cyclically therewith, said wipers being pivotally supported for movement from a retracted position within the perimeter of the discs to an actuated position slightly beyond the perimeter to forcefully displace the free margins of the released signature toward the path of the gripper means of one of the opening cylinders, means to oscillate the wipers, and means cyclically to time oscillation of the wipers so that the wipers are in actuated position to force the free margins of the released signature toward the gripper means on said one of the opening cylinders at the time those gripper means are being presented to the free margins of the released signature.

2. Machine according to claim 1 in which the wipers are supported on a rock shaft, the rock shaft having a pinion gear, a segment gear engaged with the pinion gear, and means to oscillate the segment gear.

3. Machine according to claim 2 in which the timing means includes a cam and a cam follower on the segment gear.

4. Machine according to claim 3 in which the extracting cylinder has at least three sets of extracting grippers spaced about the circumference thereof so that at least three signatures are extracted in one cycle of rotation of the extracting cylinder, and in which there are three circumferentially spaced sets of said wipers trailing the gripper sets on the extracting cylinder.

5. Machine according to claim 1 in which the extracting grippers and wipers are supported on respective rock shafts carried by said discs, the machine having fixed cams about which rotate cam followers related respectively to timing actuation of the extracting grippers and wipers, and means operated by the cam followers to actuate the grippers and wipers.

6. Cyclically operable signature gathering machine having a supply station from which folded signatures, each with a folded backbone and two sheets or legs extended therefrom, of which one sheet is longer to present an extended free margin beyond that of the shorter sheet, are to be extracted one by one by capturing the backbone of each by extracting grippers on a cyclically rotating extracting cylinder, said cylinder being defined by at least a pair of spaced discs, whereafter the captured signature is released from the extracting cylinder in the course of one turn and the two legs of the released signature opened respectively by gripper means on a pair of opening cylinders which then in turn release the opened signature to a signature gatherer, characterized by wipers supported by said discs for rotary movement cyclically therewith, said wipers being in trailing position compared to the extracting rippers and being supported for oscillating movement from a retracted position within the perimeter of the disc to an actuated position slightly beyond the perimeter to forcefully displace the free unsupported margins of the released signature toward the path of the gripper means of one of the opening cylinders, means to oscillate the wipers, and timing means cyclically to time oscillation of the wipers so that the wipers are in actuated position to force the free margins of the released signature toward the gripper means on said one of the opening cylinders at the time those gripper means are being presented to the free margins of the released signature.

7. Machine according to claim 6 in which the wipers are supported on a rock shaft, the rock shaft having a pinion gear, a segment gear engaged with the pinion gear, and means to oscillate the segment gear.

8. Machine according to claim 7 in which the timing means includes a cam and a cam follower on the segment gear.

9. Machine according to claim 6 in which the extracting cylinder has a plurality of sets of extracting grippers spaced about the circumference thereof so that a plurality of signatures are extracted in one cycle of rotation of the extracting cylinder, and in which there are a like number of sets of said wipers trailing the gripper sets on the extracting cylinder.

10. Machine according to claim 6 in which the extracting cylinder is defined by a plurality of discs keyed for rotation to a driven shaft, the extracting grippers and wipers being supported on respective rock shafts carried by said discs, the machine having fixed cams about which rotate cam followers related respectively to timing actuation of the extracting grippers and wipers, and means operated by the cam followers to actuate the grippers and wipers.

11. Machine according to claim 6 in which the extracting cylinder is defined by a pair of spaced discs, each of which carried sets of extracting grippers, and said discs also carrying sets of wipers in trailing position compared to the extracting grippers.

12. Cyclically operable signature gathering machine having a supply station from which folded signatures, each with a folded backbone and two sheets or legs extended therefrom, of which one sheet is longer to present an extended free margin beyond that of the shorter sheet, are to be extracted one by one by capturing the backbone of each by extracting grippers on a cyclically rotating extracting cylinder and moving the backbone to a fixed register gauge in the path of the extracted signature, said cylinder being defined by at least a pair of spaced discs, whereafter the captured signature engaged with the register gauge is released by the extracting grippers on the extracting cylinder in the course of one turn and the two legs of the released signature are subsequently opened by gripper means on a pair of opening cylinders which then in turn release the opened signature to a signature gatherer, characterized by wipers supported by said discs for rotary movement cyclically therewith, said wipers being located in trailing position compared to the extracting cylinder grippers and being so supported on a pivotal axis for oscillating movement from a retracted position within the perimeter of the discs to an actuated position beyond the perimeter to forcefully displace the free unsupported margins of the released signature toward the path of the gripper means of one of the opening cylinders, the trailing position of the wipers being such that the arc occupied by the released signature on the extracting cylinder is greater than the arc separating the register gauge and the wipers when actuated whereby the wipers when actuated engage the free ends of the signature, means to oscillate the wipers about their pivotal axes, and means cyclically to time oscillation of the wipers so that the wipers are in actuated position to engage and force the free margins of the released signature toward the gripper means on said one of the opening cylinders at the time those gripper means are being presented to the free margins of the released signature.

13. Signature gathering machine according to claim 12 in which the extracting cylinder is defined by a pair of spaced discs, each of which carries sets of extracting grippers, and said discs also carrying sets of wipers in trailing position compared to the extracting grippers.

14. Machine according to claim 12 in which the extracting cylinder has a plurality of sets of extracting grippers spaced about the circumference thereof so that a plurality of signatures are extracted in one cycle of rotation of the extracting cylinder, and in which there are circumferentially spaced like sets of said wipers trailing the gripper sets on the extracting cylinder.

15. Machine according to claim 12 in which the extracting cylinder is defined by a plurality of discs keyed for rotation to a driven shaft, the extracting grippers and wipers being supported on respective rock shafts carried by selected of said discs, the machine having fixed cams about which rotate cam followers related respectively to timing actuation of the extracting grippers and wipers, and means operated by the cam followers to actuate the grippers and wipers.

* * * * *